US005431747A

United States Patent [19]

Takebuchi et al.

[11] Patent Number: 5,431,747

[45] Date of Patent: Jul. 11, 1995

[54] MASTER ALLOY FOR MAGNET PRODUCTION AND A PERMANENT ALLOY

[75] Inventors: Katashi Takebuchi, Ibaragi; Koichi Yajima, Saitama, both of Japan

[73] Assignee: TDK Corporation, Tokyo, Japan

[21] Appl. No.: 19,291

[22] Filed: Feb. 18, 1993

[30] Foreign Application Priority Data

Feb. 21, 1992 [JP] Japan ..... 4-072582
Dec. 1, 1992 [JP] Japan ..... 4-345501

[51] Int. Cl.[6] ..... H01F 1/057

[52] U.S. Cl. ..... 148/302; 420/83; 420/121; 164/463

[58] Field of Search ..... 148/302, 301, 303; 420/83, 121; 164/463, 479

[56] References Cited

U.S. PATENT DOCUMENTS 4,541,877 9/1985 Stadelmaier et al. .
5,049,208 9/1991 Yajima et al. ..... 148/302
5,049,335 9/1991 Kuji et al. ..... 164/463
5,076,861 12/1991 Kobayashi et al. ..... 148/101
5,281,250 1/1994 Hamamura et al. ..... 148/302

FOREIGN PATENT DOCUMENTS 0237587 9/1987 European Pat. Off. .
0273835 7/1988 European Pat. Off. .
59-46008 3/1984 Japan .
60-17905 1/1985 Japan .
62-33402 2/1987 Japan .
62-203303 8/1987 Japan ..... 148/302
62-216202 9/1987 Japan .
62-262403 11/1987 Japan .
3-151141 6/1991 Japan .

*Primary Examiner*—George Wyszomierski
*Attorney, Agent, or Firm*—Oblon, Spivak, McClelland, Maier & Neustadt

[57] ABSTRACT

A master alloy for magnet production, which contains as main ingredients R representing at least one element selected from rare-earth elements including Y, T representing Fe or Fe and Co, and B, and includes columnar crystal grains substantially made up of $R_2T_{14}B$, and crystal grain boundaries composed primarily of R-enriched phases having an R content higher than that of $R_2T_{14}B$, said columnar crystal grains having a mean diameter lying in the range of 3 to 50 μm. The master alloy is formed into a sintered magnet through pulverization, compacting and sintering steps. The dispersion of the R-enriched phases in the master alloy is so well-enough that the R-enriched phases can also be well dispersed in the resulting sintered magnet. In addition, the master alloy is so easily pulverized that the incorporation of oxygen at the time of pulverization can be reduced. To add to this, pulverized powders having a sharp grain size distribution can be obtained, so that the sintered magnet can have crystal grains with even diameters. Thus, the sintered magnet achieved can have high magnetic characteristics.

17 Claims, 6 Drawing Sheets

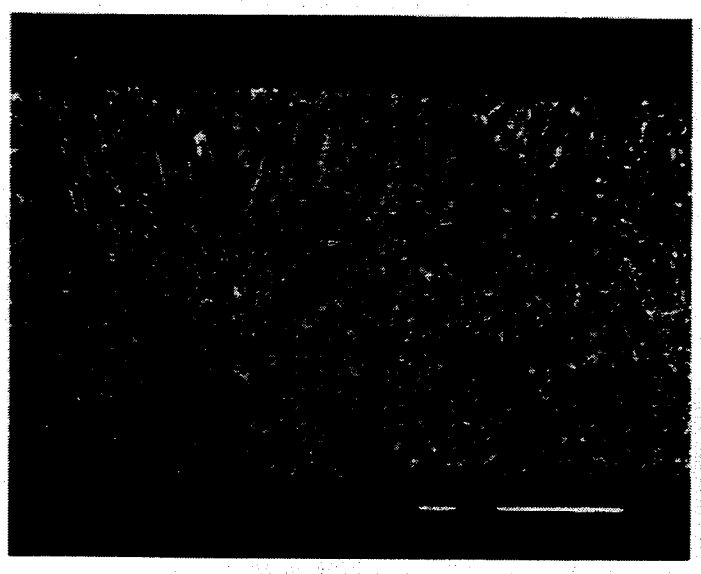
FIG. 4 100 μm
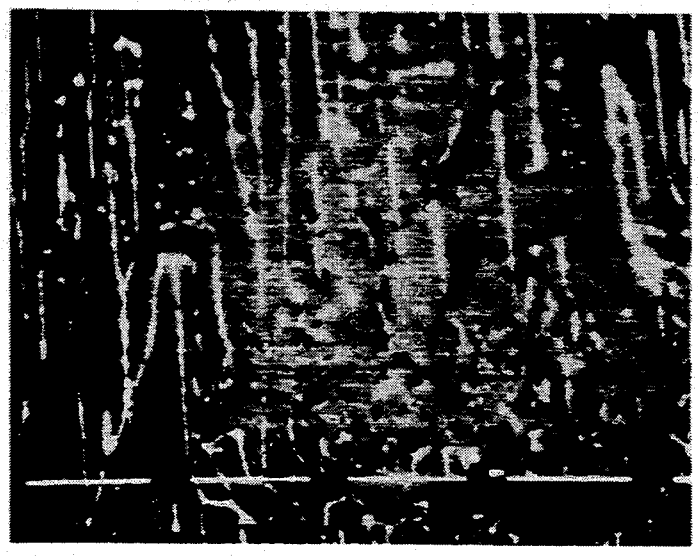
FIG. 5 100μm

MASTER ALLOY FOR MAGNET PRODUCTION AND A PERMANENT ALLOY

BACKGROUND OF THE INVENTION

The present invention relates to rare earth magnet production, a master alloy used for magnet production and master alloy production.

Rare-earth magnets of high performance, typically, powder-metallurgical Sm—Co base magnets having an energy product of 32 MGOe, have been produced on a large scale. However, a serious problem with these magnets is that the raw materials, Sm and Co, cost much. Of rare-earth elements, some elements of small atomic weight, e.g., Ce, Pr, and Nd occur more abundantly and cost less than does Sm. Fe is more inexpensive than Co. For these reasons, R—T—B base magnets (wherein T stands for Fe or Fe plus Co) such as Nd—Fe—B and Nd—Fe—Co—B magnets have recently been developed, and sintered magnets are set forth in JP-A-59-46008. Sintered magnets may be produced by the application of a conventional powder metallurgical process for Sm—Co systems (melting→master alloy ingot casting→ingot crushing→fine pulverization→compacting→sintering→magnet), and may easily achieve high magnetic properties as well.

Generally, a master alloy ingot produced by casting is made up of an $R_2Fe_{14}B$ phase of ferromagnetism (hereinafter referred to as the main phase) and a non-magnetic, R-enriched phase (again called the R-enriched phase), and is of a structure in which the main phase forming crystal grains is covered with the R-enriched phase forming grain boundaries. The master alloy ingot is then pulverized or otherwise reduced to a grain diameter smaller than the crystal grain diameter until magnet powders are obtained. Each or the magnet powder is chiefly composed of a magnet grain including the main and R-enriched phases and a magnet grain consisting substantially of the main phase alone or, in other words, being free from the R-enriched phase.

The R-enriched phase is converted into a liquid phase to have an action on accelerated sintering, and plays a vital role in the generation of a magnet's coercive force. It is thus preferable that the structure and size of the master alloy ingot and the conditions for pulverizing it are optimized, thereby preventing the R-enriched phase from being locally present in the compact.

Because of some difficulty involved in obtaining fine crystal grains by casting, however, a single crystal grain is usually pulverized to a number of magnet grains. This results in the incorporation in the resultant magnet powders of a large amount of magnet grains containing no R-enriched phase in addition to R-enriched phase-containing magnet grains. Further, the R-enriched phases, because of being segregated, are caused to exist locally in the master alloy ingot. There is thus some considerable difference in the volumes of the R-enriched phases between magnet grains.

This results in the marked local presence of the R-enriched phases in the compact, and so there is a lowering of its ability to be sintered, failing to yield a sintered magnet having high residual flux density. In addition, a sintered magnet, if somehow obtained, has only a reduced coercive force, due to the local presence of the R-enriched phases therein. Due to difficulty involved in breaking up the main phases, on the other hand, the larger the crystal grains, the longer the time taken to pulverize them to fine magnet grains and so the larger the amount of oxygen incorporated in them, not only making it impossible to obtain any high residual flux density, but making the proportion of much-coarser grains too large to obtain any high coercive force.

In order to obtain a magnet having high residual flux density, it is required to reduce the proportion of the R-enriched phases in the magnet. However, using a composition having a low R content as the starting material results in the precipitation of $\alpha$-Fe phases in the master alloy ingot. Partly because of a lowering of magnet properties due to the presence of $\alpha$-Fe phases and partly because of difficulty involved in pulverization, usually, some form of solution treatment is applied to the master alloy ingot to reduce the proportion of $\alpha$-Fe phases. However, the solution treatment, because of being carried out at an elevated temperature of about 900° C. or higher for about 1 hour or longer, gives rise to main phase and R-enriched phase growths, making the dispersion of the R-enriched phases in the master alloy ingot more unfavorable.

When the R content is reduced and so the dispersion of the R-enriched phases gets worse, the ability of the compact to be sintered gets worse or there is a need of carrying out its sintering for a longer time, during which the crystal grains grow, failing to achieve any high coercive force.

In view of such situations as mentioned above, a primary object of the invention is to improve the coercive force and residual flux density of R—T—B base sintered magnets.

SUMMARY OF THE INVENTION

Such an object is achieved by the following aspects of the invention.

(1) A master alloy for magnet production, which contains as main ingredients R representing at least one element selected from rare-earth elements including Y, T representing Fe or Fe and Co, and B, and includes columnar crystal grains substantially made up of $R_2T_{14}B$, and crystal grain boundaries composed primarily of R-enriched phases having an R content higher than that of $R_2T_{14}B$, said columnar crystal grains having a mean diameter lying in the range of 3 to 50 $\mu$m.

(2) A master alloy for magnet production as recited in (1), which is produced by cooling an alloy melt containing R, T and B as main ingredients in one direction or two opposite directions, and in which the principal-axis directions of said columnar crystal grains are substantially in alignment with the cooling direction or directions.

(3) A master alloy for magnet production as recited in (2), wherein the thickness of the master alloy, as measured in the cooling direction or directions, lies in the range of 0.1 to 2 mm.

(4) A master alloy for magnet production as recited in (1), which is substantially free from any $\alpha$-Fe phase.

(5) A master alloy for magnet production as recited in (1), which contains 27 to 38% by weight of R, 51 to 72% by weight of T, and 0.5 to 4.5% by weight of B.

(6) A master alloy for magnet production as recited in (1), produced by cooling an alloy melt containing R, T and B as main ingredients in one direction or two opposite directions.

(7) A master alloy for magnet production as recited in (6), wherein the alloy melt is cooled by a single roll procedure, a double-roll procedure or a rotary disk procedure.

(8) A permanent magnet produced by the steps of pulverizing a master alloy for magnet production as recited in (1) to obtain magnet powders, compacting the magnet powders to obtain a compact, and sintering the compact to obtain a sintered magnet.

(9) A permanent magnet as recited in (8), wherein, at the pulverizing step, the master alloy for magnet production occludes hydrogen, and is then pulverized by jet milling.

(10) A permanent magnet as recited in (9), wherein, at the pulverizing step, the hydrogen is released off after the occlusion.

(11) A permanent magnet as recited in (8), wherein, at the pulverizing step, the master alloy for magnet production is heated to a temperature ranging from 300° to 600° C., then subjected to the hydrogen occlusion treatment and finally pulverized by jet milling with no application of any hydrogen release treatment.

(12) A permanent magnet as recited in (8) wherein the master alloy is produced by cooling an alloy melt containing R, T and B as main ingredients in one direction or two opposite directions, and in which the principal-axis directions of said columnar crystal grains are substantially in alignment with the cooling direction or directions.

(13) A permanent magnet as recited in (12) wherein the thickness of the master alloy, as measured in the cooling direction or directions, lies in the range of 0.1 to 2 mm.

(14) A permanent magnet as recited in (8) wherein the master alloy is substantially free from any α-Fe phase.

(15) A permanent magnet as recited in (8) wherein the master alloy contains 27 to 38% by weight of R, 51 to 72% by weight of T, and 0.5 to 4.5% by weight of B.

(16) A permanent magnet as recited in (8) wherein the master alloy is produced by cooling an alloy melt containing R, T and B as main ingredients in one direction or two opposite directions.

(17) A permanent magnet as recited in (8) wherein the alloy melt is cooled by a single roll procedure, a double-roll procedure or a rotary disk procedure.

The master alloy used in the invention contains columnar crystal grains that have a mean diameter as small as 3 to 50 μm, and has the R-enriched phases in a well-dispersed state as well. For these reasons, the master alloy, when pulverized into magnet powders, contain R-enriched phase free magnet grains at an extremely reduced ratio and, besides, the content of the R-enriched phases in each magnet grain is substantially in the same order. No only does this make the ability of the magnet powders to be sintered good-enough, but also allows a magnet obtained by their sintering to have the R-enriched phases in a well-dispersed state, giving an increased coercive force to that magnet. In addition, some considerable ease with which pulverization is carried out enables a sharp grain size distribution to be so achieved that the grain diameters after sintering can be well put in order, ensuring that an increased coercive force can be attained. To add to this, a short pulverization time reduces the amount of oxygen incorporated, thereby attaining an increased residual flux density. Especially when pulverization follows hydrogen occlusion, it is then possible to obtain an extremely sharp grain size distribution.

The invention, because of being capable of improving the dispersion of the R-enriched phases, lends itself especially fit for the production of magnets having a reduced R content, e.g., containing R in an amount of about 27 to 32% by weight.

The master alloy of the invention may be produced by cooling an alloy melt in one or two opposite directions as by a single- or double-roll procedure.

In this connection, it is noted that JP-A-60-17905 discloses an R—T—B base magnet consisting of a composite structure made up of an R-enriched phase and an R-poor phase and as fine as 50 μm or less, with the main phase composed of a tetragonal compound. This magnet is produced by melt quenching. More illustratively, gas atomization is used for the melt quenching, thereby producing a substantially spherical form of magnet grains. However, the gas atomization technique causes melt droplets to be cooled from their surfaces, thus making the cooling rate across each magnet grain uneven. This in turn gives rise to an unfavorable dispersion of the R-enriched phases, and so makes it impossible to obtain columnar crystal grains, as can be seen from FIG. 1 attached to the specification. In short, the disclosed magnet is different from that obtained according to the invention. Example 2 set forth in JP-A-60-17905 is directed to the production of a sintered magnet, but the iHc achieved there is barely 10.5 kOe, as shown in Table 1.

JP-A-62-33402 teaches a method for producing R—T—B base magnets by sintering, wherein the cooling of an alloy after melting and casting takes place at a rate of 30° C. per minute or higher. An example referred to therein is directed to the production of a sintered magnet having an Nd content of 34% by weight. In the case of this sintered magnet, it is found that its coercive force is improved when the post-melting and-casting rate for cooling lies at 30° to 300° C. per minute. However, this sintered magnet has a coercive force of about 10 kOe at most, and JP-A-62-33402 says nothing about what crystal structure is obtained after cooling.

JP-A-62-216202 discloses a method for producing R—T—B base magnets, using an alloy that shows a macroscopically columnar structure at the time of casting, and refers to the effects achieved that pulverization can occur within a short time and a coercive force increase can be obtained as well. However, the coercive force achieved is barely about 12 kOe at most and, besides, this disclosure is silent about columnar structure size.

JP-A-62-262403 discloses a method for producing R—T—B base magnets, using an alloy in the form of an ingot in which the macro-structure is converted into a columnar structure by a zone melting technique. According to the disclosure, there are obtained the effects that pulverization can occur for a short time and a coercive force increases can be obtained as well. Although there is no disclosure about columnar structure size, the columnar structure size is considered to be large, because crystal growth can take place concurrently with the conversion of a cubic alloy into a columnar structure by zone heating. This is also clear from the fact that a coercive force of barely 12 kOe at most is obtained in an example in the specification.

BRIEF DESCRIPTION OF THE DRAWINGS

The invention will now be explained, by way of example but not by way of limitation, with reference to the accompanying drawings, in which:

FIG. 4 is a photograph that is presented as an alternative to a figure for showing a grain structure in section of a master alloy produced by the single-roll technique, FIG. 5 is a photograph that is presented as an alternative to a figure for showing a grain structure in section of a master alloy produced by the casting technique.

DETAILED EXPLANATION OF THE ILLUSTRATIVE CONSTRUCTION OF THE INVENTION

Magnet Composition

Figure 1:
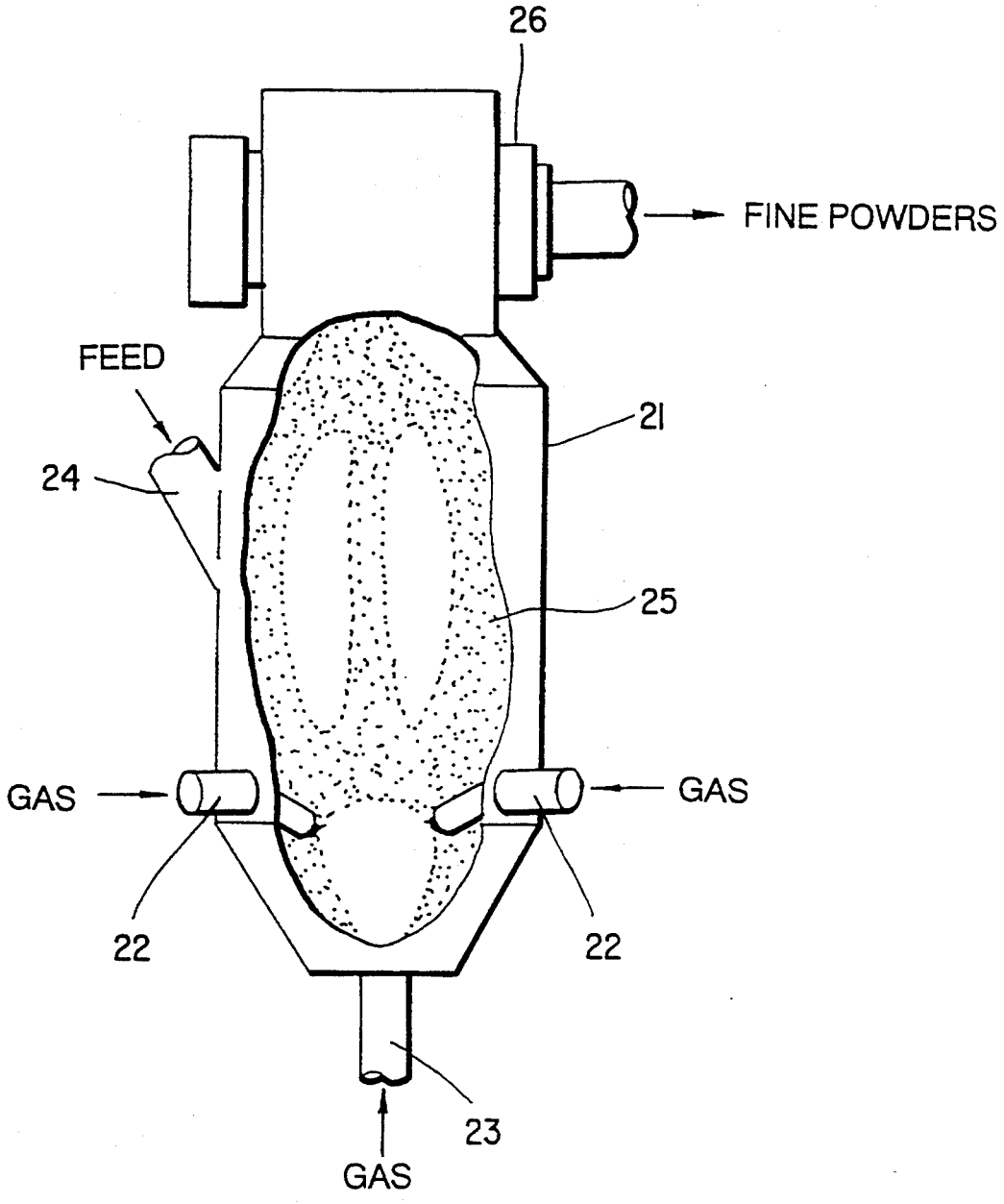
FIG. 1 is a partly cut-away, side view of a jet mill that makes use of a fluidized layer.

The invention is applied to the production of a sintered magnet containing R that represents at least one element of rare-earth elements including Y (yttrium), T that represents Fe (iron) or Fe and Co (cobalt), and B (boron), and more illustratively or preferably to a magnet containing 27 to 38% by weight of R, 51 to 72% by weight of T and 0.5 to 4.5% by weight of B. R content decreases result in residual flux density increases, but this gives rise to the precipitation of phases rich in iron such as $\alpha$-Fe phases which affects pulverization adversely. To add to this, there are decreases in the proportion of the R-enriched phases and, hence, sintered density decreases, ending up in no further residual flux density increase. According to the invention, however, it is possible to achieve sintered density increases, even when the contents of R are small. In particular, the effect of the invention is much more enhanced, when the content of R is 32% by weight or less. It is preferable, however, that R is used in an amount of 27% by weight or above, as already mentioned. Too high an R content makes it impossible to obtain any high residual flux density. Too low a B content makes it impossible to obtain any high coercive force, whereas too high a B content makes it impossible to obtain any high residual flux density. When T contains an additional Co, it is preferably used in an amount of 30% by weight or less. A further coercive force increase may be achievable by the addition of such elements as Al, Cr, Mn, Mg, Si, Cu, C, Nb, Sn, W, V, Zr, Ti and Mo, but their total amount, if exceeds 6% by weight, will leads to residual flux density decreases.

In addition to these elements, the magnet according to the invention may contain inevitable impurities or additional trace elements, e.g., carbon and oxygen.

Master Alloy

The master alloy for magnet production according to the invention contains R, T and B as main ingredients, and has a columnar crystal grain made up of a substantially tetragonal $R_2T_{14}B$ and a crystal grain boundary composed mainly of the R-enriched phase having an R content higher than that of $R_2T_{14}B$.

The composition of the master alloy may be optionally determined in dependence on the target magnet composition, but may be almost nearly identical with the magnet composition.

In accordance with the invention, the columnar crystal grains have a mean grain diameter lying at 3 to 50 $\mu$m, preferably 5 to 50 $\mu$m, more preferably 5 to 30 $\mu$m and most preferably 5 to 15 $\mu$m. At a mean grain diameter that is less than 3 $\mu$m, magnet grains obtained by pulverization take the form of polycrystals, with which no high degree of orientation is obtained, while at a mean grain diameter that exceeds 50 $\mu$m, the effect of the invention mentioned above is not achievable.

The mean grain diameter of columnar crystal grains may be found as follows. First, the master alloy is cut and polished to expose its section almost parallel to the principal-axis direction of each columnar crystal grain to view. Across this section, at least one hundred columnar crystal grains are measured for their widths and then averaged to find the mean diameter of the columnar crystal grains. It is here noted that the widths of the columnar crystal grains mean the lengths thereof, as measured in the direction vertical to the principal-axis direction.

The axial ratio of the columnar crystal grain (defined by principal-axis length/diameter), albeit being not particularly limited, usually and preferably lies in the range of about 2 to 50, especially, about 5 to 30.

The master alloy of the invention has the R-enriched phases in a well-dispersed state, as can be confirmed as through an electron microscope photograph (a reflected electron image).

The crystal grain boundary composed mainly of the R-enriched phase, although varying independence on the content of R, usually lies at about 0.5 to 5 $\mu$m in width.

Preferably, the master alloy having such a structure is produced by cooling an alloy melt containing R, T and B as main ingredients in one or two opposite directions. In the thus produced master alloy, the principal-axis direction of each columnar crystal grain is almost in agreement with the cooling direction (or directions).

In the present disclosure, it is noted that the "cooling direction" refers to the direction vertical to the surface of a cooling medium such as the peripheral surface of a cooling roll, i.e., the direction of heat transmission.

For the alloy melt cooling in one direction, use is preferably made of the single-roll and rotary disk techniques.

The single-roll technique is a procedure in which an alloy melt is injected out of a nozzle and then brought into contact with the peripheral surface of the cooling roll for cooling purposes, and which is not only simple in equipment structure and high in terms of service life but is easy to control in terms of cooling rate as well. A master alloy, when produced by the single-roll technique, is usually in a thin belt form. No critical limitation is imposed on the conditions for the single-roll technique or, in other words, those conditions may be optionally determined such that the master alloy having such a structure as mentioned above is obtainable. However, the following conditions are usually applied. The cooling roll, for instance, may be built up of various materials that are used for ordinary melt cooling procedures, such as Cu, Cu alloys such as Cu—Be alloys, and so on. Alternatively, use may be made of a cooling roll assembly built up of a roll form of material such as one mentioned just above and a surface layer provided on the surface of the roll form of material, said surface layer being made up of a metal material different from the roll form of material. This surface layer is usually provided for thermal conductivity control and wear-resistance enhancement. For instance, when the roll form of material is made up of Cu or a Cu alloy and the surface layer is formed of Cr, there is a small difference in the cooling rate of the master alloy in its cooling rate, thus assuring that the master alloy is made uniform. In addition, the good-enough wear resistance of Cr enables a larger quantity of master alloys to be continuously produced with uniform properties.

The rotary disk technique is a procedure in which an alloy melt is injected out of a nozzle and then brought into contact with a major surface of a disk form of cooling material that is rotating for cooling purposes. A master alloy, when produced by the rotary disk technique, is usually in a scaly form. It is noted, however, that the rotary disk technique involves some difficulty in obtaining uniform cooling rates, as compared with the single-roll technique, because the peripheral edge of the scaly master alloy is more rapidly cooled than the rest.

The double-roll technique is preferable for cooling an alloy melt in two opposite directions. According to this technique, two cooling rolls, each being similar to that used with the above single-roll technique, are located with their peripheral surfaces opposite to each other. Then, the alloy melt is injected between these peripheral surfaces. A master alloy, when produced by the double-roll technique, is usually in a thin belt or piece form. The conditions for carrying out the double-roll technique are not subject to any particular limitation, and so may be optionally determined such that the structure mentioned above is obtainable.

Of these cooling techniques, the most preference is given to the single-roll technique.

It is understood that the alloy melt cooling is preferably carried out either in a non-oxidizing atmosphere such as nitrogen or Ar, or in vacuo.

The master alloy, when produced by cooling an alloy melt in one or two opposite directions, has a thickness, as measured in its cooling direction, of preferably 0.1 to 2 mm, more preferably 0.2 to 1.0 mm and most preferably 0.2 to 0.5 mm. At a thickness less than 0.1 mm, it is difficult to obtain columnar crystal grains having a mean grain diameter of 3 $\mu$m or above, while at a thickness exceeding 2 mm, it is again difficult to obtain columnar crystal grains having a mean grain diameter of 50 $\mu$m or below.

With such cooling procedures, it is possible to produce a master alloy that does not substantially contain $\alpha$-Fe phases, even when the starting composition has a relatively low R content, for instance, contains about 27 to 32% by weight of R. To be more illustrative, the content of $\alpha$-Fe phases can be reduced to 5% by volume or below, especially, 2% by volume or below. This means that there is no need of using some solution treatment for reducing the proportion of other varying phases, thus enabling extremely fine columnar crystal grains to be easily obtained.

Pulverization Step

At the pulverization step, the master alloy is pulverized into magnet powders. No critical restriction is imposed on how to pulverize the master alloy, and so use may be made of suitable pulverization techniques such as mechanical pulverization and pulverization-with-hydrogen-occlusion procedures, which may be used alone or in combination. In this regard, it is noted that preference is given to the pulverization-with-hydrogen-occlusion procedure, because magnet powders having a sharp grain size distribution are then obtainable.

Hydrogen may be occluded or otherwise stored directly in the master alloy that is in thin belt or other forms. Alternatively, it may be occluded in the master alloy that has been crushed by mechanical crushing means such as a stamp mill. The crushing may usually be carried out until crude powders having a mean grain diameter of about 20 to 500 $\mu$m.

No special limitation is imposed on the conditions for the pulverization-with-hydrogen-occlusion procedure, and so reliance may be placed on ordinary conditions therefor. For instance, hydrogen occlusion and release treatments are each carried out at least once and, after hydrogen release, mechanical pulverization is done, if required.

In order to obtain magnet powders having a sharp grain size distribution, however, it is preferable that the master alloy is heated to a temperature lying in the range of 300° to 600° C., preferably 350° to 450° C., then subjected to the hydrogen occlusion treatment and finally mechanically pulverized without subjected to any hydrogen release treatment. In this process, hydrogen is selectively occluded in the R-enriched phases forming the crystal grain boundaries to increase the volumes of the R-enriched phases, so that the major phases can receive pressure and then crack from their regions contiguous to the R-enriched phases. The cracks in layer forms are likely to occur in a plane vertical to the principal-axis direction of the columnar crystal grains. Within the major phases in which little hydrogen is occluded, on the other hand, irregular cracks are most unlikely to occur. This is the reason the occurrence of much-finer and much-coarser powders is avoided in the subsequent mechanical pulverization, assuring that magnet grains with even diameters can be obtained.

The hydrogen occluded within the temperature range mentioned above forms a dihydride of R in the R-enriched phases, but the occurrence of much-coarser powders is avoided, because the dihydride of R is much easily broken.

If the master alloy stores hydrogen at a temperature less than 300° C., the resultant magnet will then contain much oxygen, because much hydrogen is also stored in the major phases and, besides, the R of the R-enriched phases is converted into a trihydride, which then reacts with $H_2O$. If the master alloy stores hydrogen at a temperature higher than 600° C., on the other hand, no dihydride of R will then be formed.

In conventional pulverization-with-hydrogen-occlusion processes, a large quantity of much-coarser powders has occurred, and so a problem has arisen in connection with a difference in the composition of R between the master alloy and the sintered magnet, because sintering follows removal of the much-coarser powders. According to the process of the invention, however, there is little difference in the composition, because the occurrence of much-coarser powders is avoided.

According to the process of the invention, it is possible to reduce the treating time because of the absence of any hydrogen release step.

The amount of hydrogen used is drastically reduced to about 1/6, because hydrogen is selectively occluded in the crystal grain boundaries but hardly in the major phases.

It is understood that hydrogen is released during the sintering of the magnet powders.

In the process of the invention, the hydrogen occlusion step is preferably carried out in a hydrogen atmosphere, but the atmosphere used may contain an inert gas such as He and Ar and other non-oxidizing gases in the form of a mixture. The partial pressure of hydrogen is usually at about 0.05 to 20 atm, but preferably lies at 1 atm or below, and the occlusion time is preferably about 0.5 to 5 hours.

For the mechanical pulverization of the master alloy after hydrogen occlusion, a pneumatic type of pulverizer such as a jet mill is preferably used. The use of a pneumatic type of pulverizer assures that magnet grains with even grain diameters can be obtained.

Jet mill equipment is generally broken down into jet mills making use of a fluidized layer, a vortical flow, an impinger plate, and so on. General structures of the jet mill making use of a fluidized layer, of the ends of part of the jet mill making use of a vortical flow, and of the jet mill making use of an impinger plate are shown in FIG. 1, 2 and 3, respectively.

In the jet mill of the structure shown in FIG. 1, a plurality of gas inlet pipes 22 extend from the peripheral side of a cylindrical vessel, shown generally at 21, and a gas inlet pipe 23 extends from the bottom of the vessel to admit gas flows into the vessel 21. A batch of feed (or the master alloys that have occluded hydrogen therein), on the other hand, is supplied through a feed supply pipe 24 into the vessel 21. The supplied feed forms a fluidized layer 25 by the gas flows introduced into the vessel 21. Within the fluidized layer 25 the master alloys collide repeatedly with each other, and they also impinge on the wall surface of the vessel 21, so that they can be finely pulverized. The thus obtained fine grains are classified through a classifier 26 mounted on the vessel 21, and then discharged out of the classifier 26. Not fully pulverized powders, if any, are fed back to the fluidized layer 25 for further fine pulverization.

Figure 2A:
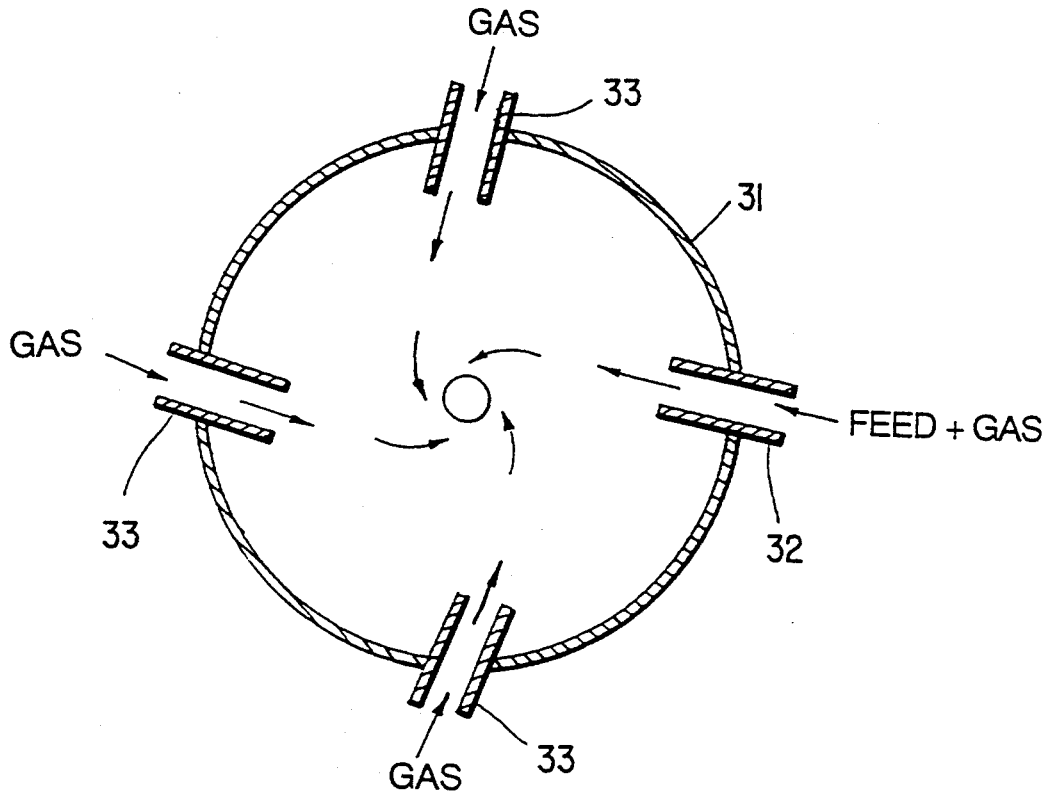
FIGS. 2*a* and 2*b* represent part of a jet mill that makes use of a vortical flow with (*a*) being a plane end view and (*b*) being a side end view.
Figure 2B:
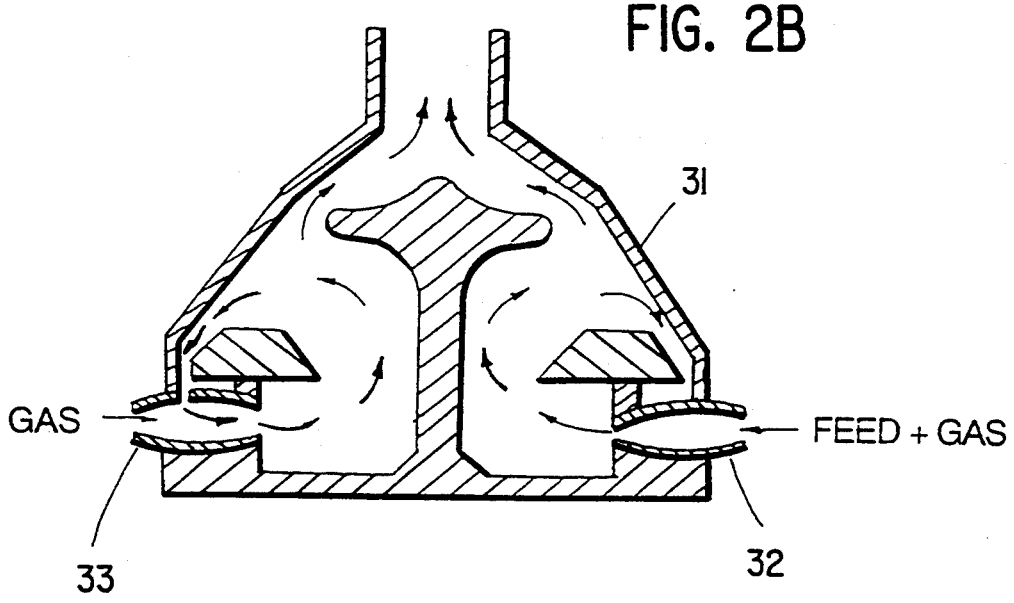

FIGS. 2*a* and 2*b* are plane and side end views showing part of the jet mill making use of a vortical flow. In the jet mill of the structure shown in FIG. 2, a feed inlet pipe 32 and a plurality of gas inlet pipes 33 extend from the wall surface of a vessel shown generally at 31. A batch of feed is supplied along with a carrier gas through the feed inlet pipe 32 into the vessel 31, and gases are jetted through the gas inlet pipes 33 into the vessel 31. The pipe 32 and the pipes 33 are located diagonally with respect to the inner wall surface of the vessel 31, so that the injected gases can form a vortical flow in the horizontal plane within the vessel 31 and define a fluidized layer by the vertical motion component. The feed mater alloys collide repeatedly with each other in the vortical flow and fluidized layer within the vessel 31, and moreover impinge on the wall surface of the vessel 31, so that they can be finely pulverized. The thus obtained fine powders are discharged out of the vessel 31 through its upper portion. Not fully pulverized powders, if any, are classified within the vessel 31, then sucked from holes in the gas inlet pipes 33, and finally re-injected along with the gases into the vessel 31 for repeated pulverization.

Figure 3:
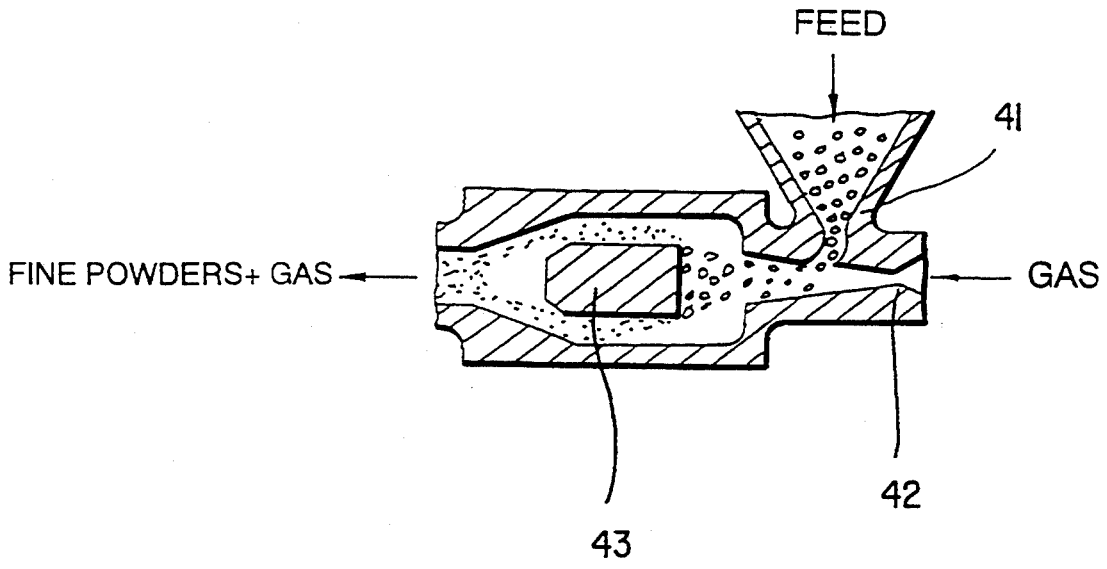
FIG. 3 is a sectional view showing part of a jet mill that makes use of an impinger plate.

In the jet mill having the structure shown in FIG. 3, a batch of feed supplied through a feed supply port 41 is accelerated by a flow of gas admitted through a nozzle 42, and then impinges on an impinger plate 43 for pulverization. The pulverized feed grains are classified, and fine powders are discharged out of the jet mill. Insufficiently pulverized powders, if any, are fed back to the port 41 for repeated pulverization in much the same manner as mentioned above.

It is understood that the gas flows prevailing in the pneumatic type of pulverizer are preferably made up of a non-oxidizing gas such as $N_2$ or Ar gas.

Preferably, the magnet grains obtained by pulverization have preferably a mean grain diameter of the order of 1 to 10 $\mu$m.

The conditions for pulverization differ in dependence on the size, composition, etc., of the master alloy, the structure of the pneumatic type of pulverizer used, and so on, and so may be determined with them in mind.

It is noted that hydrogen occlusion may cause the master alloy to crack and, moreover, may sometimes give rise to the disintegration of at least some of the master alloy. When the master alloy after hydrogen occlusion is too large in size, it may be pre-pulverized by other mechanical means, followed by pulverization with the pneumatic type of pulverizer.

Compacting Step

The magnet powders obtained through the pulverization step are usually compacted in a magnetic field, in which case the strength of the magnetic field is preferably 15 kOe or more and the compacting pressure is preferably on the order of 0.5 to 3 t/cm$^2$.

Sintering Step

Usually, it is preferable that the resultant compact is sintered at 1,000° to 1,200° C. for about 0.5 to 5 hours, and then quenched. It is noted that the sintering preferably takes place in an atmosphere such as an inert gas (e.g., Ar gas) atmosphere or in vacuo. It is then preferable that, after the sintering, aging is carried out in a non-oxidizing atmosphere or in vacuo. In this case, the aging is preferably carried out at two stages. At the first aging stage, the sintered compact is held at a temperature ranging from 700° to 900° C. for 1 to 3 hours. This is followed by a first quenching step at which the aged compact is quenched to the range of room temperature to 200° C. At the second aging stage, the quenched compact is retained at a temperature ranging from 500° to 700° C. for 1 to 3 hours. This is followed by a second quenching step at which the aged compact is quenched to room temperature. At the first and second quenching steps, it is preferable to use the cooling rates of 10° C. per minute or higher, especially, 10° to 30° C. per minute. In addition, it is noted that the heating rate to the hold temperature at each aging stage may usually be about 2° to 10° C. per minute, although not critical.

After the aging treatments, the compact may be magnetized, if required.

EXAMPLES

The present invention will now be explained, more illustratively but not exclusively, with reference to some examples.

Example 1

An alloy melt having the composition of 29% by weight Nd, 1.5% by weight Dy, 1.0% by weight B and the balance Fe was cooled by the single-roll technique in an Ar gas atmosphere to produce a thin belt form of Master Alloy No. 1-1 of 0.3 mm in thickness and 15 mm in width. The quench surface speed of the cooling roll was 2 meters per second.

Another batch of the alloy melt of 1500° C. was cast into a mold having a cavity width of 20 mm to produce Master Alloy No. 1-2 similar in composition to No. 1-1.

Master Alloy No. 1-1 was cut to expose the plane including the cooling direction to view, and then polished along the section to take a shot of the reflected electron image by an electron microscope. This photograph, attached hereto in the form of FIG. 4, indicates that there are columnar crystal grains with the principal-axis direction being the cooling direction (the thickness direction of the thin belt). The mean diameter of one hundred columnar crystal grains across this section was calculated to be 9.6 μm, and the absence of α-Fe phases was noted as well.

On the other hand, Master Alloy No. 1-2 was cut to expose the plane vertical to the cavity wall to view, and then polished along the section to take a shot of the reflected electron image by an electron microscope. This photograph, again attached to the present disclosure in the form of FIG. 5, reveals that there are columnar crystal grains extending from the surface of contact of the cavity wall therewith. The mean diameter of one hundred columnar crystal grains across the section are calculated to be 70 μm, and the presence of α-Fe phases is noted along the section as well. The area ratio of the α-Fe phases was found to be 5% by volume or above, as measured by EPMA.

Then, each Master Alloy was crushed to diameters of about 5 to 20 mm. Subsequently, the Master Alloy was subjected to the hydrogen occlusion treatment under the following conditions, and then to the mechanical pulverization with no application of any hydrogen release treatment, thereby obtaining magnet powders.

Hydrogen Occlusion Treatment

Master Alloy Temp.: 400° C.
Treatment Time: 1 hour
Atmosphere for Treatment: Hydrogen Atmosphere of 0.5 atm.

For the mechanical pulverization, the jet mill having the structure shown in FIG. 2 was used. The pulverization was carried out under magnet powders having a mean grain diameter of 4 μm were obtained. The then efficiencies of pulverization were 60 g per minute in the case of Master Alloy No. 1-1 and 40 g per minute in the case of Master Alloy No. 1-2. In other words, it was ascertained that Master Alloy No. 1-1 (according to the invention) is easier to pulverize than Master Alloy No. 1-2 (for comparison).

Then, the magnet powders obtained from Master Alloy No. 1-1 or 1-2 were pressed in a magnetic field of 15 kOe at a pressure of 1.5 ton/cm$^2$ for compacting, and the resultant compact was sintered at 1,050° C. for 1 hour in an Ar atmosphere, then quenched, and finally aged at 600° C. for 3 hours in an Ar atmosphere to obtain a sintered magnet. The thus obtained magnets have the magnetic properties shown in Table 1.

TABLE 1

| Master Alloy Nos. | Magnet Properties iHc, kOe, | Br, kG, | $(BH)_{max}$, MGOe |
|---|---|---|---|
| 1-1 | 17.5 | 13.6 | 44.2 |
| 1-2 (Comparison) | 14.1 | 13.3 | 41.5 |

Example 2

An alloy melt having the composition of 30% by weight Nd, 1.0% by weight B and the balance Fe was cooled by the single-roll technique at varying roll peripheral speeds, referred to in Table 1, thereby producing master alloys similar to Master Alloy No. 1-1 obtained in Example 1. As investigated in the same manner as in Example 1, each master alloy was found to have a crystal structure consisting of columnar crystal grains, as in the case of Master Alloy No. 1-1. The cooling-direction thicknesses of these master alloys and the mean grain diameters of the columnar crystal grains forming them were measured. The results are set out in Table 2. Then, the master alloys were pulverized, and the obtained magnet powders were compacted, sintered, and aged to obtain sintered magnets. The pulverization, compacting, sintering and aging were much the same as in Example 1. The magnetic characteristics of these sintered magnets are also shown in Table 2.

TABLE 2

| Master Alloy No. | Roll's Peripheral speed (m/s) | Thickness (mm) | Mean Columnar Crystal Grain Diameter | Magnet Properties iHc (kOe) | Br (kG) | (BH)max (MGOe) |
|---|---|---|---|---|---|---|
| 2-1(Comparison) | 0.5 | 0.52 | 100 | 12.1 | 13.4 | 42.7 |
| 2-2 | 1 | 0.35 | 30 | 13.8 | 13.6 | 43.8 |
| 2-3 | 2 | 0.20 | 10 | 14.5 | 13.6 | 44.2 |
| 2-4 | 4 | 0.11 | 5 | 14.7 | 13.5 | 43.5 |
| 2-5(Comparison) | 6 | 0.09 | 2 | 14.6 | 13.1 | 40.8 |
| 2-6(Comparison) | 10 | 0.08 | 0.5 | 14.8 | 12.5 | 38.3 |

The results shown in Tables 1 and 2 make the effect of the invention clear. In other words, the master alloys produced by the single-roll technique and containing columnar crystal grains having a mean grain diameter of 3 to 50 μm according to the invention have the good-enough ability to be pulverized and contain no α-Fe phases albeit having a relatively low R content, and so achieve magnets having excellent-enough magnetic characteristics.

Example 3

Figure 6:
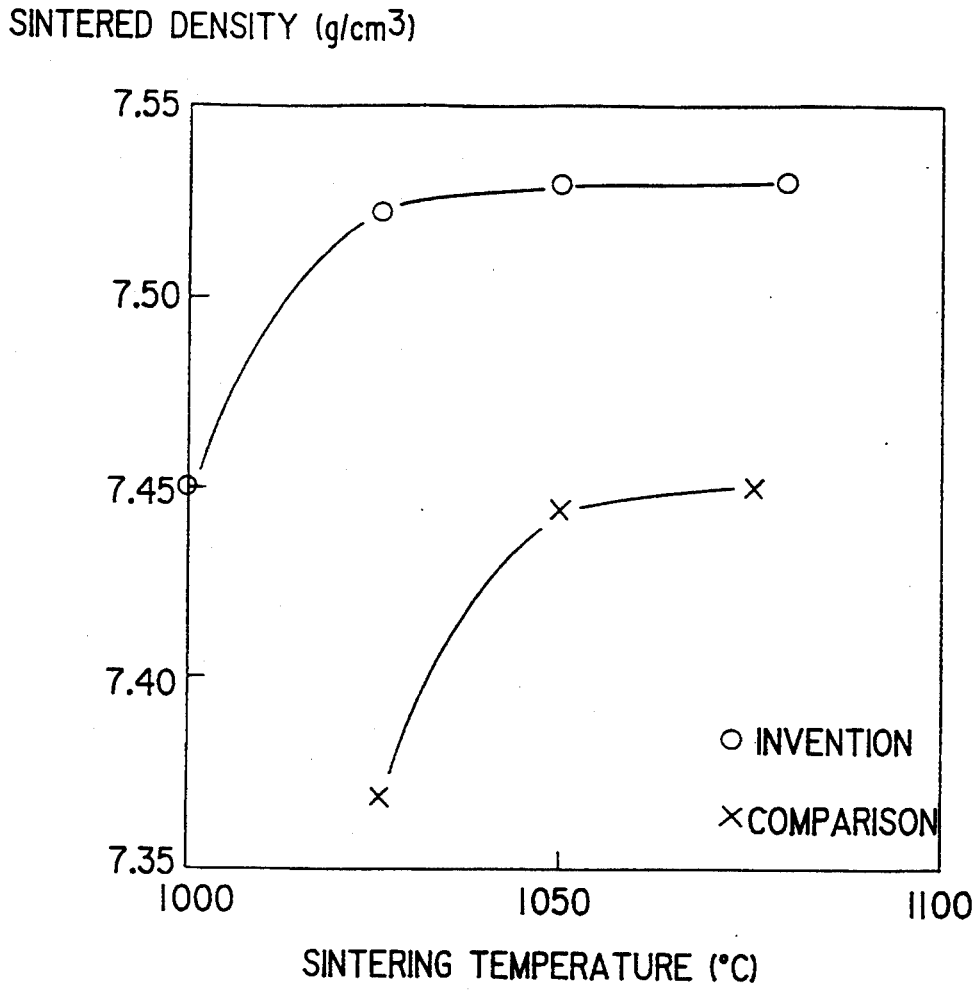
FIG. 6 is a graph showing the relation between sintering temperature and sintered density.

Master Alloy Nos. 1-1 and 1-2 were used to obtain sintered magnets following Example 1 but at varying sintering temperatures shown in FIG. 6. The sintered densities (magnet densities) of the resultant magnets are shown in FIG. 6.

As can be seen from FIG. 6, Master Alloy No. 1-1 (according to the invention) gives a higher-density magnet at a lower temperature than does Master Alloy No. 1-2 (for comparison).

Example 4

Master alloys having compositions of 27–34% by weight Nd, 1.0% by weight Dy, 1.0% by weight B and the balance Fe were produced under the same conditions as in the case of Master Alloy Nos. 1-1 and 1-2 obtained in Example 1, respectively. The master alloys produced under the same conditions as in the case of Master Alloy No. 1-1 were found to contain columnar crystal grains with the mean grain diameter lying in the range of 5 to 20 μm, but those produced under the same conditions as in the case of Master Alloy No. 1-2 were found to contain columnar crystal grains with the mean grain diameter lying in the range of 60 to 200 μm.

These master alloys were used to produce sintered magnets according to Example 1. However, the sintering was done at 1,075° C. As regards the magnets obtained with the master alloys produced under exactly the same conditions as in the case of Master Alloy No 1-1 and produced under exactly the same conditions as in the case of Master Alloy No. 1-2, the relations between the R (Nd+Dy) contents and the residual flux densities, Br, and sintered densities. The results are plotted in FIG. 7.

Figure 7:
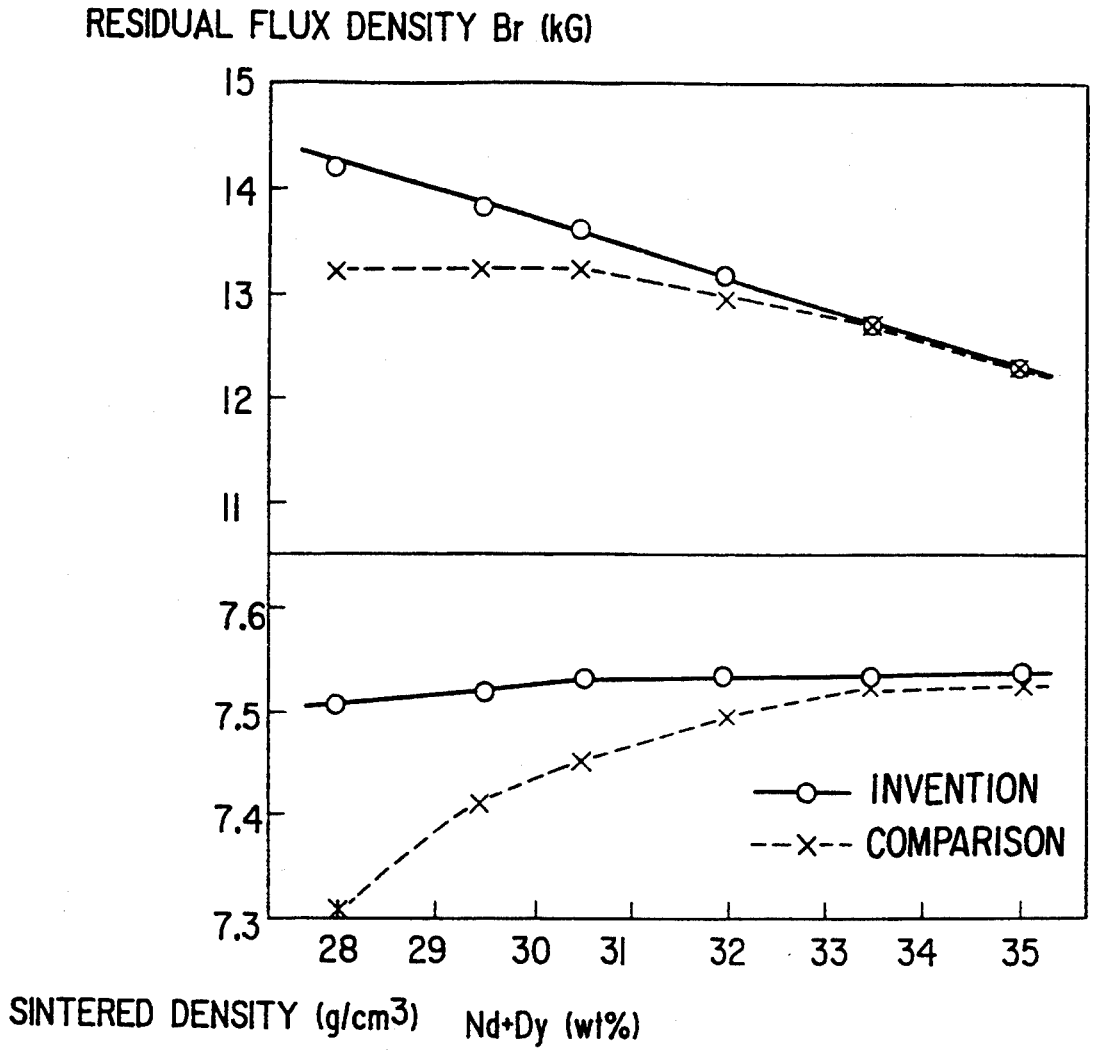
FIG. 7 is a graph showing the relations between the content of R and residual flux density Br and sintered density.

As can be seen from FIG. 7, the comparative magnets decrease in terms of sintered density with a decrease in the R content; that is, no further increase in residual flux density is obtainable. However, the magnets according to the invention undergo little lowering in terms of sintered density and so achieve an extremely high residual flux density.

The results of the examples make the effect of the invention clear.

What we claim is:

1. A master alloy for producing a permanent magnet, which comprises:

27–32% by weight of element R which is at least one element selected from the group consisting of the rare earth elements including Y, the element T which is Fe or Fe and Co, and B, which alloy includes columnar crystal grains substantially made up of $R_2T_{14}B$ and having a mean diameter lying within the range of 3 to 50 μm, a mean principal axis/diameter ratio lying within the range of 5 to 50, and crystal grain boundaries composed primarily of R-enriched phases having an R content greater than that of $R_2T_{14}B$, and which have been produced by cooling an alloy melt containing R, T and B as main ingredients in one direction or two opposite directions, and in which the principal axis directions of said columnar crystal grains are substantially in alignment with the cooling direction or directions.

2. The master alloy as recited in claim 1, wherein the thickness of said master alloy, as measured in the cooling direction or directions, lies in the range of 0.1 to 2 mm.

3. The master alloy as recited in claim 2, wherein said alloy melt is cooled by a single roll procedure, a double-roll procedure or a rotary disk procedure.

4. The master alloy as recited in claim 1, wherein said master alloy is substantially free from any α-Fe phase.

5. The master alloy as recited in claim 1, which comprises 27 to 32% by weight of R, 51 to 72% by weight of T, and 0.5 to 4.5% by weight of B.

6. The master alloy as recited in claim 1, which contains 27 to 30.5% by weight of R, 51 to 72% by weight of T, and 0.5 to 4.5% weight of B.

7. The master alloy as recited in claim 1, which contains 27 to 30% by weight of R, 51 to 72% by weight of T, and 0.5 to 4.5% weight of B.

8. A permanent magnet produced by the steps comprising:

producing a master alloy for magnet production by cooling an alloy melt containing R, T and B as main ingredients in one direction or two opposite directions, thereby forming an alloy containing columnar crystal grains whose principal axis directions are substantially in alignment with the cooling direction or directions, said master alloy comprising 27 to 30% by weight of an element R which is at least one element selected from the group consisting of the rare earth elements including Y, T being Fe or Fe and Co, and B, which alloy includes columnar crystal grains substantially made up of $R_2T_{14}B$ and having a mean diameter lying in the range of 3 to 50 μm, a mean principal axis/diameter ratio lying within the range of 5 to 50, and crystal grain boundaries composed primarily of R-enriched phases having an R content greater than that of $R_2T_{14}B$;

pulverizing said master alloy for magnet production to prepare magnet powder;

compacting the magnet powder to prepare a compact; and sintering the compact to prepare a sintered magnet.

9. The permanent magnet as recited in claim 8, which further comprises, prior to said pulverizing step, heating the alloy under an atmosphere containing hydrogen thereby occluding hydrogen within the alloy, and then performing said pulverizing step in a jet mill.

10. The permanent magnet as recited in claim 9, wherein, at the pulverizing step, the occluded hydrogen is released.

11. The permanent magnet as recited in claim 8, which further comprises, prior to said pulverizing step, heating the master alloy for magnet production to a temperature ranging from 300° to 600° C. under an atmosphere containing hydrogen thereby occluding hydrogen within the alloy, and then immediately performing said pulverizing step in a jet mill without the application of any hydrogen release treatment.

12. The permanent magnet as recited in claim 8, wherein the thickness of the master alloy, as measured in the cooling direction or directions, lies in the range of 0.1 to 2 mm.

13. The permanent magnet as recited in claim 8, wherein the master alloy is substantially free from any α-Fe phase.

14. The permanent magnet as recited in claim 8, wherein the master alloy contains 27 to 32% by weight of R, 51 to 72% by weight of T, and 0.5 to 4.5% by weight of B.

15. The permanent magnet as recited in claim 8, wherein the alloy melt is cooled by a single roll procedure, a double-roll procedure or a rotary disk procedure.

16. The permanent magnet as recited in claim 8, wherein the master alloy contains 27 to 30.5% by weight of R, 51 to 72% by weight of t, and 0.5 to 4.5% weight of B.

17. The permanent magnet as recited in claim 8, wherein the master alloy contains 27 to 30% by weight of R, 51 to 72% by weight of T, and 0.5 to 4.5% weight of B.

* * * * *